United States Patent [19]

Meyer

[11] 3,947,961

[45] Apr. 6, 1976

[54] SHAVING HEAD FOR DRY-SHAVERS

[75] Inventor: Gerald Meyer, Klagenfurt, Austria

[73] Assignee: U.S. Philips Corporation, New York, N.Y.

[22] Filed: Apr. 29, 1974

[21] Appl. No.: 465,311

[30] Foreign Application Priority Data

May 18, 1973 Austria ..... 4366/73

[52] U.S. Cl. ..... 30/41

[51] Int. Cl.[2] ..... B26B 19/44

[58] Field of Search ..... 30/41, 42, 44, 45, 41.6, 30/90, 43.91

[56] References Cited

UNITED STATES PATENTS

| | | | |
|---|---|---|---|
| 2,192,726 | 5/1940 | Williams | 30/90 |
| 2,598,292 | 5/1952 | O'Russa | 30/41.6 |
| 2,787,053 | 4/1957 | Kleinman | 30/90 |
| 3,079,684 | 3/1963 | Hertzberg | 30/41 |

*Primary Examiner*—Al Lawrence Smith
*Assistant Examiner*—Robert C. Watson
*Attorney, Agent, or Firm*—Frank R. Trifari; J. David Dainow

[57] ABSTRACT

Shaving head for a dry-shaver having an arched perforated cutter foil and a cooperating lower cutter resiliently urged into the foil. For cleaning purposes the lower cutter is rotatable about a longitudinal axis from the first position, in which its blade edges cooperate with the foil, to a second position in which the blade edges are accessible for cleaning, when the shaving head is removed from the shaver.

9 Claims, 10 Drawing Figures

SHAVING HEAD FOR DRY-SHAVERS

BACKGROUND OF THE INVENTION

The invention relates to a shaving head for dry-shavers which has at least one shaving part comprising a perforated cutter foil, which is arched transversely of the direction of length of the shaving head, and a lower cutter of arched cross-section, which is adapted to be reciprocated in the direction of length of the shaving head and is resiliently pressed with its blades into the arch of the cutter foil. The relative positions of the cutter foil and the lower cutter are changeable for cleaning purposes by relative movement of these elements about an axis which extends in the direction of length of the shaving head. To enable the relative positions of the cutter foil and the lower cutter to be changed, the cutter foil frequently is mounted on a support which is attached to the shaving head so as to be pivotable about an axis extending in the direction of length thereof, as described for example in Austrian Pat. No. 296,815. When the support is pivoted away from the shaving head, the lower cutter and the cutter foil are freely accessible, permitting the lower cutter to be cleaned and the foil to be replaced. Since in this position of the support the foil is freely accessible, it is liable to be damaged. Considering that a shaving head is to be cleaned far more often than the foil is to be replaced, the likelihood of damaging the foil is comparatively frequent. This likelihood is avoidable if the entire shaving head is detachable or adapted to be pivoted away from the dry-shaver, and is cleaned from the open side opposite the foil, in which case the foil support obviously should not be pivoted away from the shaving head. Such an arrangement is possible, but it impedes ready accessibility of the blades of the lower cutter which cooperate with the foil, so that such a cleaning operation may not give satisfactory results and is laborious. It has been found that for achieving satisfactory shaving effect of the shaver it is important that the edges of the lower cutter blades should be clean.

SUMMARY OF THE INVENTION

It is an object of the present invention to enable a shaving head of the above-described kind, and particularly the lower cutter and its blades, to be simply cleaned while reducing the likelihood of damaging the cutter foil to a minimum. For this purpose according to the invention the axis of the relative movements of the foil and the lower cutter is situated substantially in the plane of symmetry of the lower cutter which extends in the direction of length of the shaving head, the lower cutter is mounted in the shaving head that when the shaving head is removed or pivoted from the shaver for cleaning, the lower cutter is rotatable from a first position, in which it has its blades pressed into resilient engagement with the foil and is reciprocable, to a second position in which the lower cutter edges are accessible from the open side of the shaving head opposite the foil. Thus the lower cutter performs a rotary movement relative to the foil during which, for the purpose of cleaning the lower cutter and in particular its blade edges, the foil can remain in its operational position on the head so that it is not exposed to an additional risk of damage as would be the case when it should have to be pivoted away from the shaving head.

Advantageously the axis about which the lower cutter is rotatable is situated in the region of the center of curvature of the arched contour of the cross-section of the lower cutter. This permits a compact construction of the shaving head, because the lower cutter requires little additional space for its rotation.

The lower cutter may simply be rotated by the user grasping it from the open side of the shaving head and rotating it. However, with regard to simple operation it has proved of advantage to provide at least one operating member for rotating the lower cutter. In this connection it is of particular advantage for the operating member to be in the form of a rotary knob which is sunk into a lateral transverse part of the shaving head and is externally accessible and preferably is externally knurled.

The shaving head and the lower cutter usually are cleaned by means of a special brush. Advantageously, however, the lower cutter can be cleaned during its rotation if a brush is mounted on a longitudinal part of the shaving head so as to extend along this part and to engage the blades of the lower cutter when the latter is being rotated to its second position. In this connection it has further proved of advantage for the brush to be mounted on a strip which is pivoted to the shaving head and can manually be locked in a position suitable for engagement of the brush with the lower cutter by means of a snap catch. Thus the brush can simply be pivoted clear of the lower cutter so that the shaving head is readily accessible for example for thorough cleaning with a separate brush.

Since the lower cutter in its first position is adapted to be reciprocatingly driven, for constructional purposes a frame-shaped support for the lower cutter is preferably provided so as to extend in the direction of length of the shaving head. The lower cutter is slidably guided in the direction of its reciprocating operational motion on the support and is inseparably attached thereto in the normal direction, while the support is rotatably mounted in the shaving head for rotation of the lower cutter.

The provision of a support for the lower cutter furthermore allows a plurality of advantageous designs of a shaving head according to the invention with a view to effective construction, reliability and ease of operation. Thus at least to define the first of the two positions of the lower cutter, a locking mechanism operative between the support and the shaving head is provided so that the first position of the lower cutter in which it cooperates with the cutter foil and, if desired, the position in which its blades are accessible for cleaning are simply and accurately defined. Furthermore the support on its surface more remote from the lower cutter may carry a brush which extends in the direction of length of the support and which when the support is rotated engages the foil so as to clean it, dispensing with the need for a separate cleaning operation. Advantageously the support at its surface more remote from the lower cutter is formed with at least one rib of arched cross-section which extends at right angles to the direction of length of the support and the contour of which supportingly follows the arched inner surface of the foil in the second position of the lower cutter. Thus the foil is supported in both positions of the lower cutter so that always the same favorable conditions for protecting the foil against damage exist. To ensure that the lower cutter occupies a defined position also when the shaving head is removed from the dry-shaver, a spring system is advantageously provided for resiliently urging the blade edges of the lower cutter to the foil, which system at one end abuts on the support of the lower cutter and at the other end on the lower cutter itself so that it is continuously operative. In this connection it is further advantageous to connect a lateral transverse part of the shaving head and the lower cutter by a pin-and-slot motion which displaces the lower cutter when it is rotated from its first position into the second position towards the support against the action of the spring system. Thus the lower cutter when rotated is lifted clear of the foil, preventing the foil from being damaged by this operation.

BRIEF DESCRIPTION OF THE DRAWINGS

Embodiments of the invention will now be described by way of non-limitative example with reference to the accompanying diagrammatic drawings. Each embodiment is shown in longitudinal section view in a first Figure and in transverse cross-section in a second Figure.

DETAILED DESCRIPTION OF THE PREFERRED EMBODIMENTS

Figure 1:
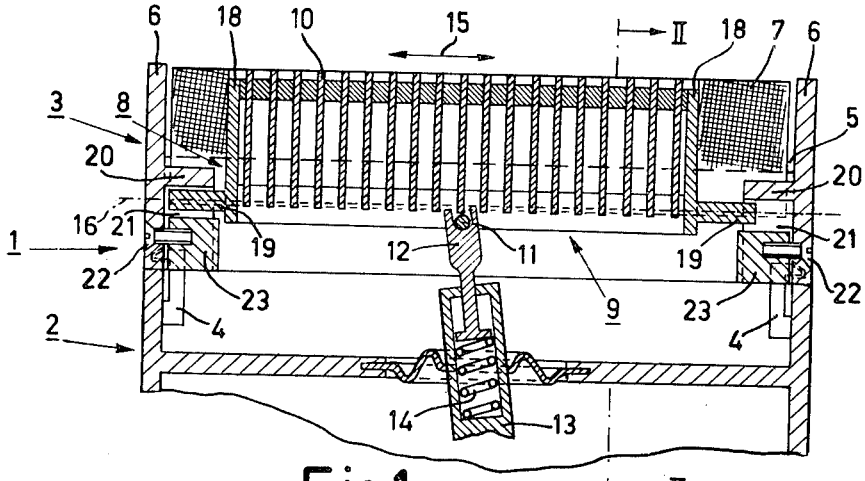
FIGS. 1 and 2 show an embodiment in which the lower cutter is simply rotatably mounted in slots.
Figure 2:
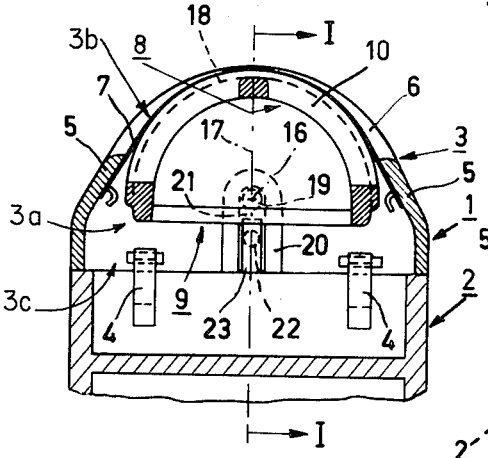

Referring now to FIGS. 1 and 2, a dry-shaver 1 comprises a housing 2, which accommodates a driving motor, and a shaving head 3, which is adapted to be placed on the housing 2 and then can be secured by resilient hooks 4. The frame-shaped shaving head has two longitudinal parts or side walls 5 and two lateral cross parts 6 or end walls 6, defining therein a cutter chamber 3*a* with open top and bottom parts 3*b* and 3*c*. A perforated cutter foil 7 of arched section is secured in known manner to the longitudinal parts 5 closing the open top part 3*b*. The foil cooperates with a lower cutter 8 which comprises blades 10 embedded in a carrier 9 and a driving pin 11. The blades are arched when viewed in a cross-section of the lower cutter, the edges of the arches constituting the cutting edges. When the shaving head is in place on the housing the driving pin 11 of the lower cutter is engaged by a fork 12 which is mounted on a vibrating-armature lever 13 of a vibrating-armature motor, not shown, which lever projects from the casing 2. The fork 12 is adapted to be displaced in the direction of length of the lever 13 by the action of a spring 14. Thus the lower cutter has its blade edges resiliently urged against the arched foil by the spring 14 and also is reciprocable in the direction of length of the shaving head, as is indicated by a double-headed arrow 15.

As is known, such a shaving head is frequently to be cleaned of the shaved hairs, for which purpose the relative positions of the cutter foil and the lower cutter have to be changed to render the lower cutter and its blades accessible. In the embodiment shown in FIGS. 1 and 2 this is achieved in that the lower cutter 8 is arranged in the head so as to be rotatable about an axis 16 which lies substantially in a plane of symmetry 17 of the lower cutter which extends in the direction of length of the head 3 and also is the plane of symmetry of this head 3. For this purpose the lower cutter 8 has two stub axles 19 which extend coaxially in the direction of length of the shaving head and project from end cheeks 18 of the support 9 and lie in the region of the center of curvature of the arched contour of the cross-section of the lower cutter. The two lateral cross parts 6 of the shaving head are formed with projections 20 which are directed toward the interior of the head and each have a slit 21 situated in the plane of symmetry 17 of the lower cutter, which plane extends in the direction of length of the shaving head. The stub axles 19 of the lower cutter 8 are inserted into the slits 21, the open ends of which are closed by insertion pieces 23 which are inserted into the slits and are secured to the cross parts 6 of the shaving head by screws 22. The dimensions of the slits and the stub axles are selected so that the lower cutter 8 is movable both in the direction of the reciprocating operative movement and, under the action of the spring 14, in the direction of the arch of the cutter foil. FIG. 1 shows the lower cutter in a position produced at maximum travel in one direction of the reciprocating operative movement of the lower cutter.

When the shaving head is to be cleaned of the shaved hairs, it is removed or pivoted away from the casing part 2, permitting in known manner a first cleaning from the open end opposite the cutter foil. However, cleaning the blade edges of the lower cutter which cooperate with the foil is of particular importance. For this purpose the lower cutter in its first position is grasped and according to the invention rotated to a second position in which its blades are directly accessible from the open end of the shaving head. The lower cutter is rotated about the stub axles 19 inserted in the slits 21, and this movement does not require additional space in the shaving head, because the axis 16 about which the cutter is rotatable lies in the region of the center of curvature of the arched cross-section of the lower cutter. In its second position the lower cutter and particularly its blades can simply be cleaned. This operation requires no change in position of the cutter foil so that the likelihood of its being damaged is reduced to a minimum.

For replacing a cutter foil either the lower cutter is removed from the shaving head by unscrewing the bolts 22 and removing the insertion pieces 23 or the cutter foil is simply replaced from the upper end of the shaving head with the lower cutter in the second position.

Figure 4:
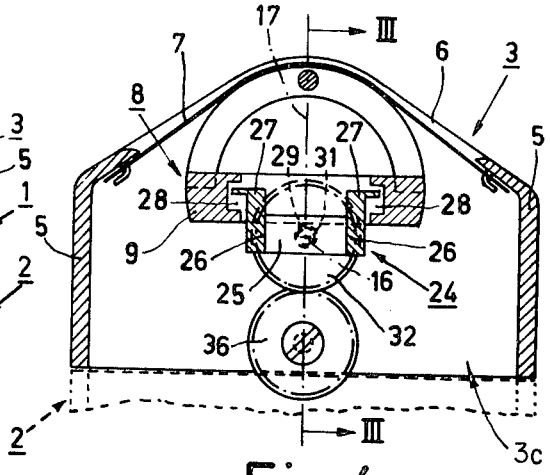
FIGS. 3 and 4 show an embodiment in which the lower cutter is mounted on a support which is adapted to be rotated by means of an operating member.
Figure 3:
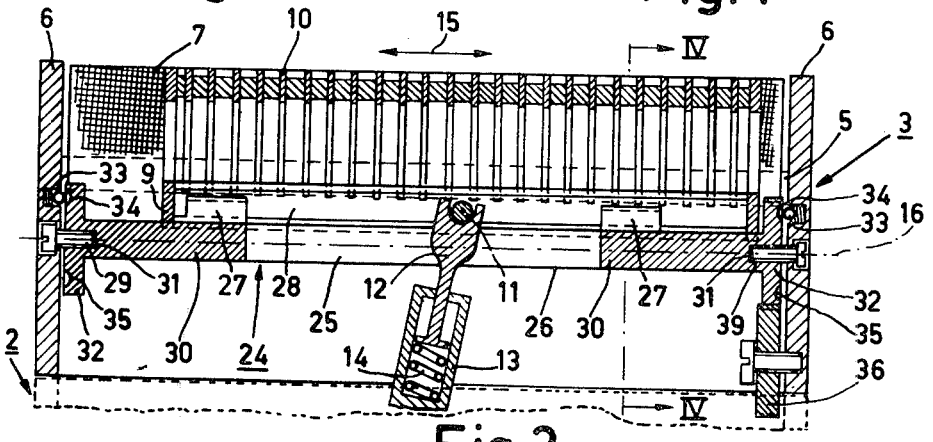

In the embodiments shown in the FIGS. 3 and 4, the lower cutter 8 is mounted on a support 24 which extends in the direction of length of the shaving head 3, the cutter being guided on the support so as to be capable of sliding in the direction 15 of the reciprocating operative movement but so as to be undetachable in a direction at right angles thereto. The support 24 has the shape of a frame through the opening 25 of which projects the fork 12 which is mounted on the vibrating-armature lever 13, engages with the pin 11 for driving the lower cutter 8 and is loaded by the spring 14. The longer members 26 of the frame are formed with L-shaped projections 27 the free ends of which project into corresponding recesses 28 in the body 9 of the lower cutter 8 with the result that the lower cutter is guided so as to be slidable in the direction of length of the shaving head. Viewed in the direction of the force exerted by the spring 14 the width of the recesses 28 exceeds the thickness of the free ends of the projections 27 so that in this embodiment also the lower cutter 8 can be pressed into the arch of the foil 7 by the spring 14. This arrangement further results in that the lower cutter is undetachably attached to the support.

To enable the lower cutter to be rotated, the support 24 is mounted in the shaving head 3 so as to be rotatable about the axis 16 situated in the plane of symmetry 17 of the lower cutter which extends in the direction of length of the head. In this embodiment the axis 16 comprises stub axles 29 which are screwed into the lateral cross parts 6 of the shaving head. The shorter members 30 of the frame of the support 24 are formed with bores 31 into which the stub axles 29 project so that the support is rotatable about them. In this embodiment the axis 16 is situated, viewed from the foil, beneath the centre of curvature of the arched contour of the cross-section of the lower cutter.

The shorter members 30 of the frame of the support 24 which face the lateral cross parts 6 of the shaving head are formed with disk-shaped wheels 32 between whose surfaces which face the cross parts 6 and these parts 6 ball-catches 33 are provided one at each end, suitably disposed recesses 34 and 35 in the lateral surfaces of the wheels 32 defining the two positions of the support and hence of the lower cutter. One of the two wheels 32 is toothed and meshes with a toothed wheel 36 mounted on the corresponding cross part 6 of the shaving head. The toothed wheel 36 is arranged so as to be accessible from the open end of the shaving head, thus constituting an operating member for rotating the support about the axis 16.

The operation is similar to that of the first embodiment. After the shaving head has been removed from the housing part, rotation of the toothed wheel 36 enables the support 24 and hence the lower cutter to be rotated from their first positions to positions such that the cutter blades are accessible from the open end of the shaving head, this second position being defined by the ball-catches 33 and the recesses 35. After cleaning, rotation of the wheel 36 enables the lower cutter to be returned to its first position which is defined by the ball-catches 33 and the recesses 34. Good cooperation of the lower cutter and the foil requires particularly this first position to be accurately defined. However, for cleaning the lower cutter also it is of advantage that it should be locked in the second position. Owing to the rotation of the lower cutter relative to the foil the latter again need not change position to permit cleaning.

In the embodiment shown in FIGS. 5 and 6 a frame-shaped support 24 for the lower cutter 8 is again provided on which the cutter is guided so as to be slidable in the direction of the reciprocating operative movement while being fixedly attached to it in a direction at right angles thereto in a manner similar to that described with reference to the embodiment shown in FIGS. 3 and 4. To enable the support and the lower cutter to be jointly rotated two operating members are provided which also fix the axis 16 for the movement of the lower cutter relative to the foil. For this purpose rotary knobs 38, which are accessible from the outside and are mounted in the cross parts 6 of the shaving head by means of stub axles 37, are sunk in these cross parts and are secured to the support 24 by screws 39 so as to form an integral rotary unit with it.

In this embodiment the blades of the lower cutter are resiliently urged to the foil by means of a spring system in the form of a leaf spring 40 which abuts on projections 41 formed on the support 24 and on the body 9 of the lower cutter 8. Thus the position of the lower cutter is defined even when the shaving head is removed from the casing part, since the cutter is maintained in engagement with the arched foil by the spring.

To rotate the support together with the lower cutter the shaving head is held in one hand and the rotary knobs 38 are grasped by the thumb and forefinger of the other hand, after which a relative rotation is performed. Advantageously the rotary knobs are externally knurled for ease of manipulation.

To prevent the lower cutter from being continuously pressed by the spring 40 against the foil during rotation, in this embodiment the lateral cross parts 6 of the shaving head and the lower cutter 8 are connected by a pin-and-groove guide arrangement which when the lower cutter is rotated from its first position to its second position displaces it against the action of the spring 40 towards the support 24 and thus lifts it from the foil. For this purpose the lateral cross parts 6 of the shaving head are formed in their inner surfaces with grooves 43 which each receive a free end of a rod 44 which on either side projects beyond the lower cutter 8. The grooves 43 extend around the axis 16 and are shaped so as to enable the lower cutter in its first position to be freely urged to the foil, whereas when the lower cutter is rotated from this first position they embrace the rod 44 and shift it so that the lower cutter is displaced toward the support against the action of the spring 40. In the direction 15 of the reciprocating operative movement of the lower cutter the grooves are so deep as not to impede this movement. To enable the free ends of the rod 44 to be inserted into the closed grooves detachable closure members 45 are provided one at each end of the open side of the shaving head so as to permit the grooves to be opened.

Figure 5:
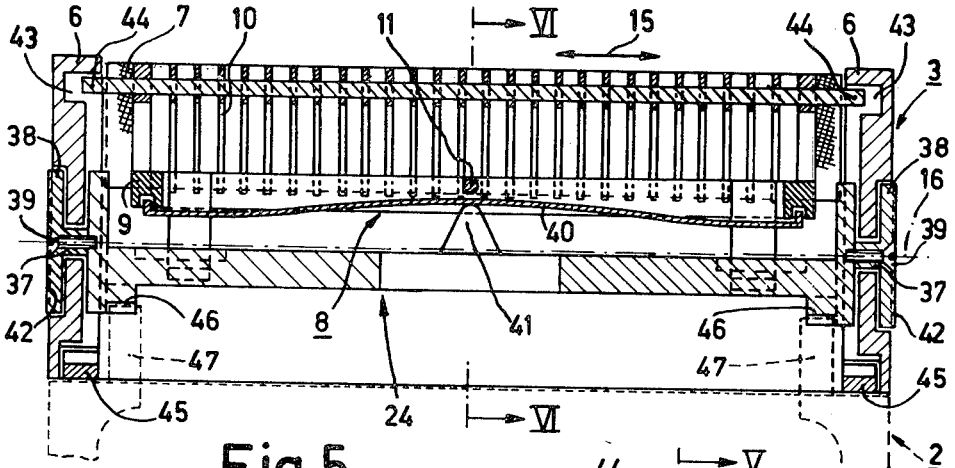
FIGS. 5 and 6 show an embodiment in which a spring system effective between the support and the lower cutter is provided for pressing the cutter to the cutter foil.
Figure 6:
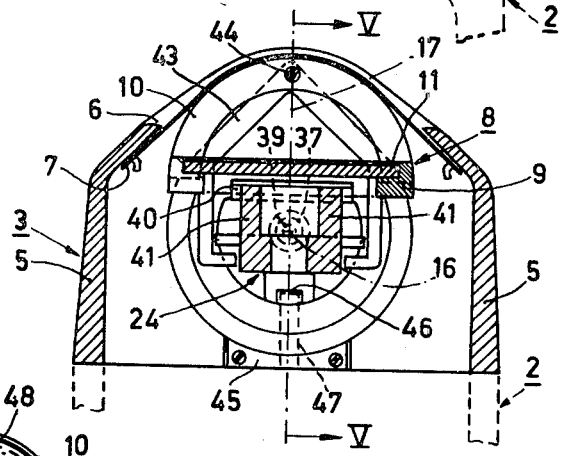

The surface of the support 24 more remote from the lower cutter 8 is formed with two recesses 46 which cooperate with projections 47 formed on the housing part 2 by means of their relative shapes, as is shown schematically by broken lines in FIGS. 5 and 6. This ensures that the shaving head can only be placed on the housing part 2 in completed operative position if the support 24 and the lower cutter 8 are in their first positions in which the lower cutter cooperates with the foil in the manner intended for operation of the shaver.

Figure 8:
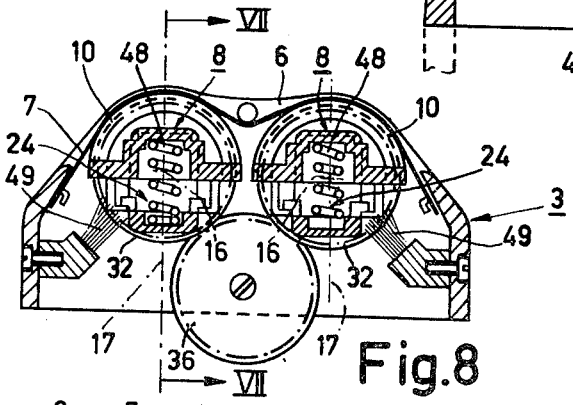
FIGS. 7 and 8 show an embodiment of a shaving head having two shaving sections the lower cutters of which are jointly rotatable.
Figure 7:
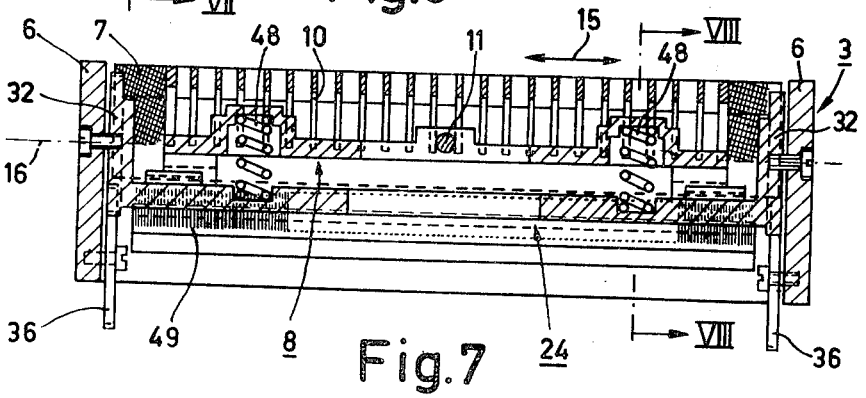

FIGS. 7 and 8 show a shaving head which has two shaving arrangements which each comprise a lower cutter mounted on a support 24, both cutters cooperating with a doubly arched foil 7. Spring systems in the form of helical springs 48 are mounted each between a lower cutter 8 and the associated support 24.

Rotation of each lower cutter 8 together with the associated support 24 about the axis 16 situated in the plane of symmetry 17 of each lower cutter is effected similarly to that described with reference to the embodiment shown in FIGS. 3 and 4, except that two operating members are provided for simultaneous rotation of both lower cutters. Hence both disk-shaped wheels 32 of each support 24 are externally toothed. Toothed wheels 36 are mounted one on each of the two lateral cross parts 6 of the shaving head. Each toothed wheel 36 meshes with the teeth of the disk-shaped wheels 32 of both supports 24. Rotation of the two lower cutters is simply effected in that the shaving head is grasped with both hands, one of the two toothed wheels 36 being turned by the thumb of each hand.

Two brushes 49 are arranged one on each of the longer members 5 of the shaving head and project into the range covered by the blades of the adjacent lower cutter 8 when rotated. Thus the lower cutters are cleaned already when rotated. If desired, when the lower cutters are in the second position they may obviously be additionally cleaned by means of a separate brush.

Figure 9:
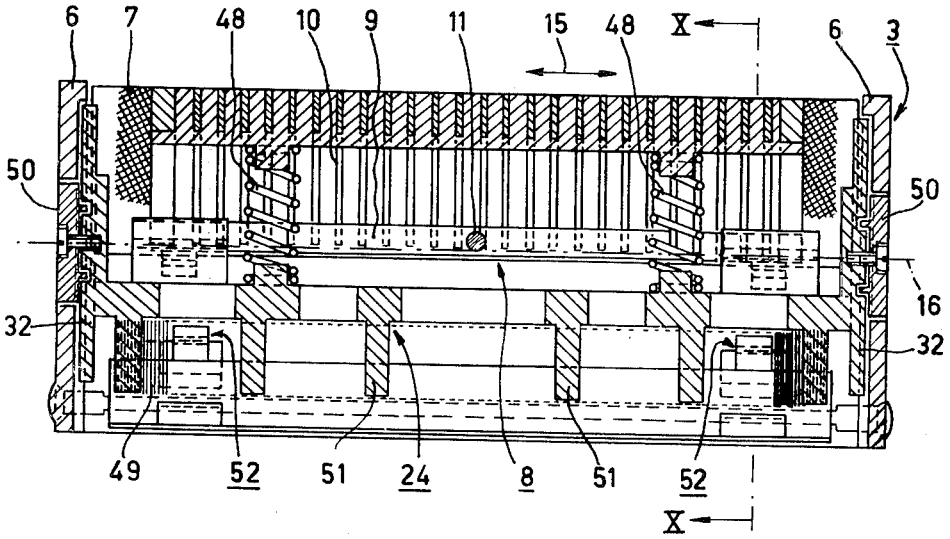
FIGS. 9 and 10 show a preferred embodiment in which in the second position of the lower cutter the support supports the foil.

In the embodiment shown in FIGS. 9 and 10 the support 24 for the lower cutter 8 is rotated in a manner analogous to that described with reference to the embodiment shown in FIGS. 5 and 6 by means of two rotary knobs 50 which are externally accessible and are journalled in the lateral cross parts 6 of the head. The rotary knobs transmit the rotation movement to the support 24 by friction and determine the axis of rotation 16 of the lower cutter.

In this embodiment the support 24 is formed in its surface remote from the lower cutter with a plurality of protective ribs 51 which extend at right angles to the direction of length of the support and are of arched cross-section, their contours supportingly following the arched shape of the foil 7 in the second positions of the support and lower cutter. This ensures that in the second position of the lower cutter, in which position the blades 10 do not engage the foil 7, the ribs 51 support the foil similarly to the blades, thus preventing deformation of the foil which may give rise to damage.

For the purpose of cleaning the lower cutter during its rotation, in this embodiment also a brush 49 is provided which extends along a longer member 5 of the shaving head and is mounted on a strip 53 which in this embodiment is hinged to the shaving head and is locked in the position of cooperation between the brush and the lower cutter by a snap connection 52 which can be released by hand. When the strip 53 is released from the snap connection 52, the brush 49 can be pivoted out of the range covered by the rotating lower cutter. Thus a lower cutter when in its second position is readily accessible for cleaning by means of a separate brush.

Figure 10:
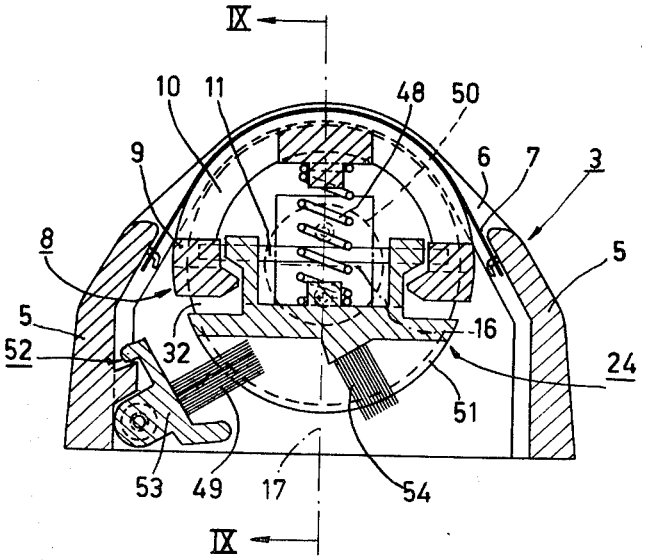

As FIG. 10 shows, a further brush 54 is secured along the surface of the support 24 remote from the lower cutter and engages the foil 7 when the support is rotated, so that there is no need for separate cleaning of the foil.

Obviously many modifications of the above described embodiments are possible without departing from the spirit and scope of the invention.

I claim:

1. In a dry shaver, a shaving head removable from a shaver housing for cleaning, the shaving head comprising: a frame having side walls extending lengthwise defining therein a cutter chamber with open top and bottom parts, a perforated foil outer cutter secured to said frame closing said top part, a lower cutter having a plurality of blades with cutting edges, and a longitudinal axis in a plane of symmetry, mounting means for mounting said cutter in said frame in a first position with said cutting edges thereof resiliently urged against said foil at said top part, said cutter being rotatable about said axis, between said first position and a second position wherein said cutting edges are rotated toward said bottom open part to be accessible for cleaning, said shaver further comprising movable operating means engaging said lower cutter for moving said cutter between said first and second positions.

2. Apparatus according to claim 1 wherein said operating means comprises a knob rotatably mounted on said frame.

3. Apparatus according to claim 1 further comprising means for releasably securing said cutter in at least said first position.

4. In a dry shaver, a shaving head removable from a shaver housing for cleaning, the shaving head comprising: a frame having side walls extending lengthwise defining therein a cutter chamber with open top and bottom parts, a perforated foil outer cutter secured to said frame closing said top part, a lower cutter having a plurality of blades with cutting edges, and a longitudinal axis in a plane of symmetry, mounting means for mounting said cutter in said frame in a first position with said cutting edges thereof resiliently urged against said foil at said top part, said cutter being rotatable about said axis, between said first position and a second position wherein said cutting edges are rotated toward said bottom part to be accessible for cleaning, said shaver further comprising a brush mounted on a wall of said frame for cleaning said cutting blades when said cutter is in said second position thereof.

5. Apparatus according to claim 4 wherein said brush is movable between a cooperating position for cleaning said cutter blades and a non-cooperating position relative to said blades.

6. Apparatus according to claim 5 further comprising means for releasably locking said brush in one of said positions thereof.

7. In a dry shaver, a shaving head removable from a shaver housing for cleaning, the shaving head comprising: a frame having side walls extending lengthwise defining therein a cutter chamber with open top and bottom parts, a perforated foil outer cutter secured to said frame closing said top part, a lower cutter having a plurality of blades with cutting edges, and a longitudinal axis in a plane of symmetry, mounting means for mounting said cutter in said frame in a first position with said cutting edges thereof resiliently urged against said foil at said top part, said cutter being rotatable about said axis, between said first position and a second position wherein said cutting edges are rotated toward said bottom open part to be accessible for cleaning, said mounting means comprising a support-frame on which said cutter is secured, means on said support frame for guiding said cutter in longitudinal movement, and means for rotatably mounting said support-frame whereby said cutter carried by said support-frame is rotatable about said longitudinal axis thereof.

8. In a dry shaver, a shaving head removable from a shaver housing for cleaning, the shaving head comprising: a frame having side walls extending lengthwise defining therein a cutter chamber with open top and bottom parts, a perforated foil outer cutter secured to said frame closing said top part, a lower cutter having a plurality of blades with cutting edges, and a longitudinal axis in a plane of symmetry, mounting means for mounting said cutter in said frame in a first position with said cutting edges thereof resiliently urged against said foil at said top part, said cutter being rotatable about said axis, between said first position and a second position wherein said cutting edges are rotated toward said bottom open part to be accessible for cleaning, said shaver further comprising a brush secured to said cutter on a part thereof remote from said cutting edges, said brush contacting and cleaning said foil when said cutter is rotated from first to second position.

9. Apparatus according to claim 8 further comprising spring means resiliently urging said support-frame and cutter thereon toward said foil.

* * * * *